US008262241B2

(12) United States Patent
Liu

(10) Patent No.: US 8,262,241 B2
(45) **Date of Patent: *Sep. 11, 2012**

(54) RETRACTABLE LAMP PEN OPERATING IN ALTERNATE MODES

(75) Inventor: Liang Liu, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/027,211

(22) Filed: Feb. 14, 2011

(65) Prior Publication Data

US 2011/0134630 A1 Jun. 9, 2011

Related U.S. Application Data

(63) Continuation of application No. 12/582,660, filed on Oct. 20, 2009, now Pat. No. 7,887,212.

(30) Foreign Application Priority Data

Oct. 23, 2008 (CN) ..... 2008 1 0121922

(51) Int. Cl.
*F21V 33/00* (2006.01)

(52) U.S. Cl. ..... 362/118; 401/195

(58) Field of Classification Search ..... 362/118; 401/195

See application file for complete search history.

(56) References Cited

U.S. PATENT DOCUMENTS

| | | | | |
|---|---|---|---|---|
| 2,905,147 | A | 9/1959 | Johmann | |
| 3,051,132 | A | 8/1962 | Johmann | |
| 3,137,276 | A | 6/1964 | Weisser | |
| 3,288,115 | A | 11/1966 | Hechtle | |
| 5,131,775 | A | 7/1992 | Chen | |
| 5,570,967 | A | 11/1996 | Chen | |
| 7,887,212 | B2 * | 2/2011 | Liu | 362/118 |
| 2004/0161287 | A1 * | 8/2004 | Yu | 401/195 |
| 2007/0041177 | A1 * | 2/2007 | Lin | 362/118 |
| 2009/0196021 | A1 * | 8/2009 | Liu | 362/118 |

* cited by examiner

*Primary Examiner* — Laura Tso

(74) *Attorney, Agent, or Firm* — Christensen O'Connor Johnson Kindness PLLC

(57) ABSTRACT

A lamp pen comprises a lower body, an upper body attachable to the lower body, a refill and a lamp disposed in the lower body, a conductive spring disposed about the pen refill, a rotating body assembly disposed in the upper body and having a battery, conductive terminals, and a rotating wheel, a conductive guiding sleeve, a conductive element, and a push button assembly.

Repeatedly depressing the push button assembly causes the rotating body assembly to rotate such that the assembly moves between a first position wherein the refill is retracted into the lower body, a second position wherein the refill is extended, the conductive terminals of the body assembly engage the conductive guiding sleeve causing the lamp to illuminate, a third position wherein the refill is retracted, and a fourth position wherein the refill is extended and the lamp is not illuminated.

20 Claims, 5 Drawing Sheets

RETRACTABLE LAMP PEN OPERATING IN ALTERNATE MODES

BACKGROUND

Currently, there are many writing instruments, for example, retractable ball-point pens, known in the art that have built-in lamps, such as LED lamps, thus making the pen usable in a dark environment. Usually, retractable pens with built-in lamps work as follows: when a pen's writing end is extended out of the pen, the built-in lamp turns on, and when the pen's writing end is retracted, the lamp turns off. However, pens of the above kind have a serious shortcoming: the lamp always turns on when the pen's writing end is out, which reduces a lamp battery life as the lamp stays turned on even in a bright environment when the lamp is not needed for writing.

There are retractable lamp pens known in the art that have separate switches for turning a built-in pen lamp on and off. However, the above solution also has a shortcoming in that it requires providing additional hardware associated with a lamp switch, which results in increased cost, assembly problems, and diminished reliability compared to a conventional retractable pen. Furthermore, a user has to use two separate switches in one pen, one for extending a pen's writing end out of the pen's body, and another for illuminating the lamp. Therefore, there is a need to provide a retractable pen having a built-in lamp that would switch on only when necessary, for example, in a dark environment, and that could be turned off in a light environment, wherein extending and retracting a writing end of the pen and turning on and off a built-in lamp could be operated by a single switch.

SUMMARY

The following summary is provided to introduce a selection of concepts in a simplified form that are further described below in the Detailed Description. This summary is not intended to identify key features of the claimed subject matter, nor is it intended to be used as an aid in determining the scope of the claimed subject matter.

A retractable lamp pen operating in alternate modes is disclosed. In one embodiment, the lamp pen comprises a lower body having a transparent distal end and a conductive proximal end, an upper body having a first end removably attachable to the lower body proximal end and a second end defining a button aperture, a refill disposed in the lower body, the refill having a writing end and a conductive tail plug, a first conductive spring disposed about the pen refill, a rotating body assembly, a rotating wheel, a conductive guiding sleeve, a conductive element, a push button, and a lamp.

The rotating body assembly defines a battery holder that holds a battery. The rotating body assembly is adapted to engage the conductive tail plug such that the conductive tail plug is electrically connected to the battery. The rotating body assembly further comprises (i) a tubular housing defining a pair of sliding slots, (ii) a conductive plate having opposing terminals that slidably engage the sliding slots, and (iii) a second conductive spring having a first end that electrically engages the battery and a second end that electrically engages the conductive plate away from the battery.

The rotating wheel comprises a plurality of protrusions extending outwardly from the rotating body assembly tubular housing and defining four longitudinal guiding slots and four angled chutes.

The conductive guiding sleeve is fixedly disposed in the upper body, defining four longitudinal inner ribs sized and oriented to slidably engage the rotating wheel guiding slots, and a pair of terminals.

The conductive element has a first end that electrically engages the guiding sleeve terminals, and a second end that electrically engages the conductive proximal end of the lower body.

A push button assembly is slidably retained in the upper body having a narrow portion extending through the upper body button aperture and is rotatably locked with respect to the upper body. The push button assembly is biased toward the button aperture, wherein pushing the push button assembly against the bias causes the push button assembly to engage the rotating wheel.

The lamp is disposed in the distal end of the lower body and has a first lead electrically connected to the first conductive spring and a second lead electrically connected to the conductive element.

Repeatedly pushing the push button assembly causes the rotating body assembly to rotate such that the rotating body assembly moves sequentially between a first position wherein the refill is retracted into the lower body, a second position wherein the refill is extended in which the writing end extends out of distal end of the lower body and the terminals of the conductive plate engage the terminals of the conductive guiding sleeve illuminating the lamp, a third position wherein the refill is retracted, and a fourth position wherein the refill is extended and the lamp is not illuminated.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
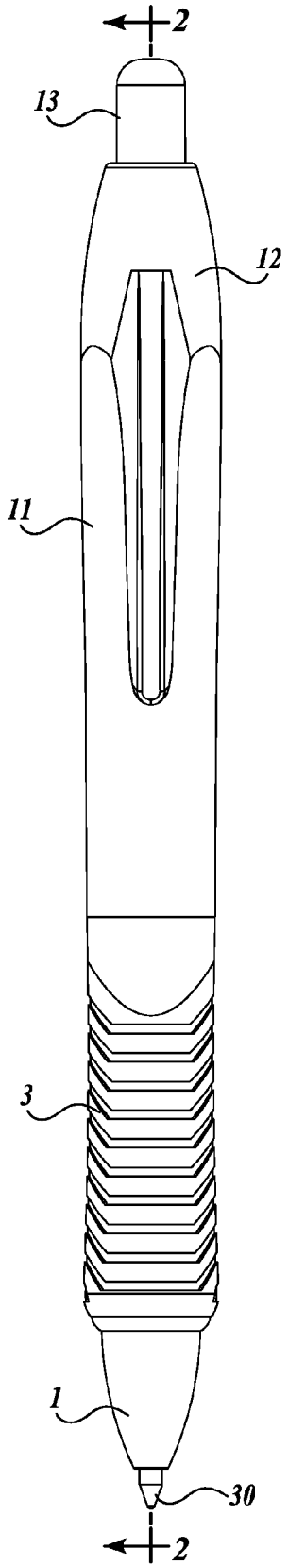
FIG. 1 is a front elevation view of an embodiment of a retractable lamp pen constructed in accordance with the present application.

FIGS. 1-5 illustrate an embodiment of a lamp pen, comprising a lower body 1 enclosed by a sheath 3, an upper body 11, and a refill 23 having a writing end 30 disposed inside the lower body 1. A lamp 24, in one embodiment an LED lamp, is fixedly disposed in the lower body 1. The refill 23 is disposed inside a first conductive spring 22. A tail of the refill 23 is enclosed by a conductive tail plug 6 such that one end of the first conductive spring 22 contacts the tail plug 6, and the other end of the first conductive spring 22 contacts a cathode of the LED lamp 24.

A battery cartridge 20 is disposed in the upper body 11 along with a pressing wheel 15 and a rotating wheel 17 that are adapted to engage each other. One or more batteries 21 are disposed in the battery cartridge 20. The battery cartridge 20 and the rotating wheel 17 form a rotating body assembly. A second conductive spring 8 is disposed between the tail plug 6 and a cathode of the batteries 21. In one embodiment, a diameter of a lower end of the second conductive spring 8 is larger than a diameter of an upper end thereof. A tail plug cover 7 may be disposed on the tail plug 6 and has a through aperture to receive the second conductive spring 8. The lower end of the second conductive spring 8 is disposed between the tail plug cover 7 and the tail plug 6, while the upper end of the second conductive spring 8 passes the tail plug cover 7 through the aperture and contacts the cathode of the batteries 21.

A conductive central ring 5 is fixedly disposed on the lower body 1 so that the upper body 11 and the central ring 5 are adapted to be in threaded connection. An inner liner 2 is fixedly disposed in the lower body 1 between the first conductive spring 22 and the lower body 1. An anode of the LED lamp 24 is disposed through the inner liner 2 such that it contacts the central ring 5.

Figure 2:
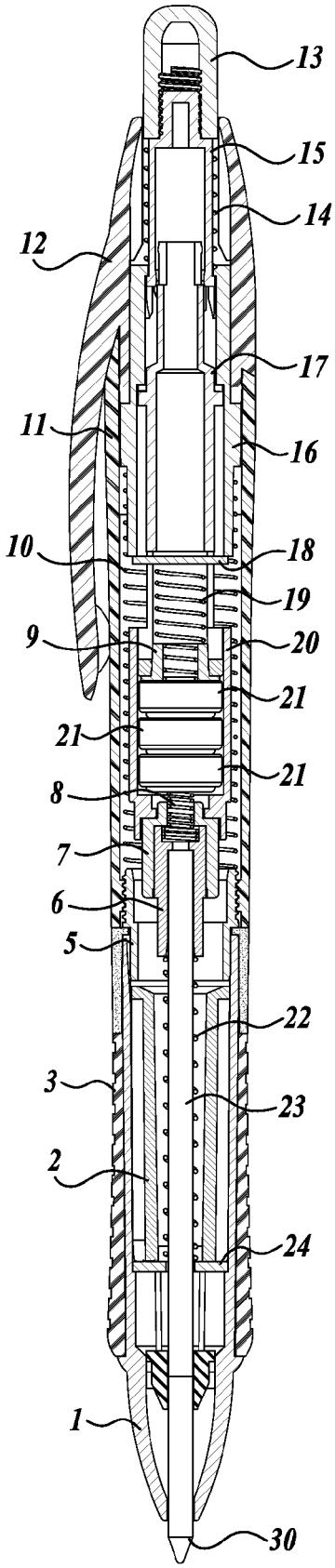
FIG. 2 is a sectional view of the lamp pen shown in FIG. 1.
Figure 3:
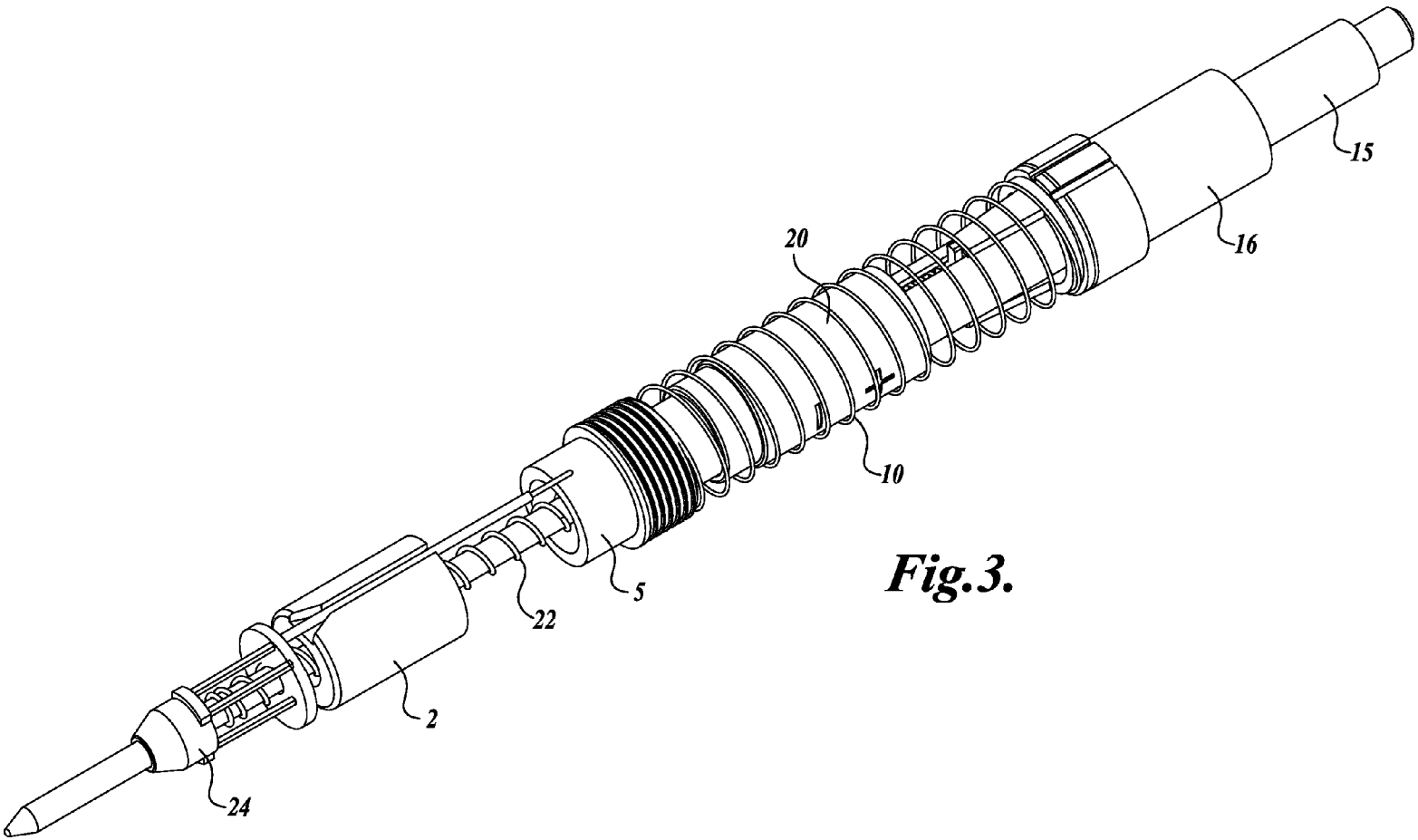
FIG. 3 is a perspective view of internal structure of the lamp pen shown in FIGS. 1 and 2.

In the embodiment shown in FIGS. 1 and 2, a pen clip 12 is fixedly disposed on the upper body 11. A conductive guiding sleeve 16 is fixedly disposed in the upper body 11 proximate to pen clip 12. A conductive connector, in one embodiment a conductive spring 10, may be disposed around and along the guiding sleeve 16 such that an end of the conductive spring 10 contacts the central ring 5, thus providing an electric connection between the sleeve 16 and the central ring 5.

One end of the pressing wheel 15 passes through the guiding sleeve 16. The other end of the pressing wheel 15 is adapted to be in threaded connection with a push button 13. A rest spring 14 is disposed between the pressing cap 13 and the guiding sleeve 16. Four guiding longitudinal inner ribs are integrally disposed on the inner wall of the guiding sleeve 16.

Figure 5:
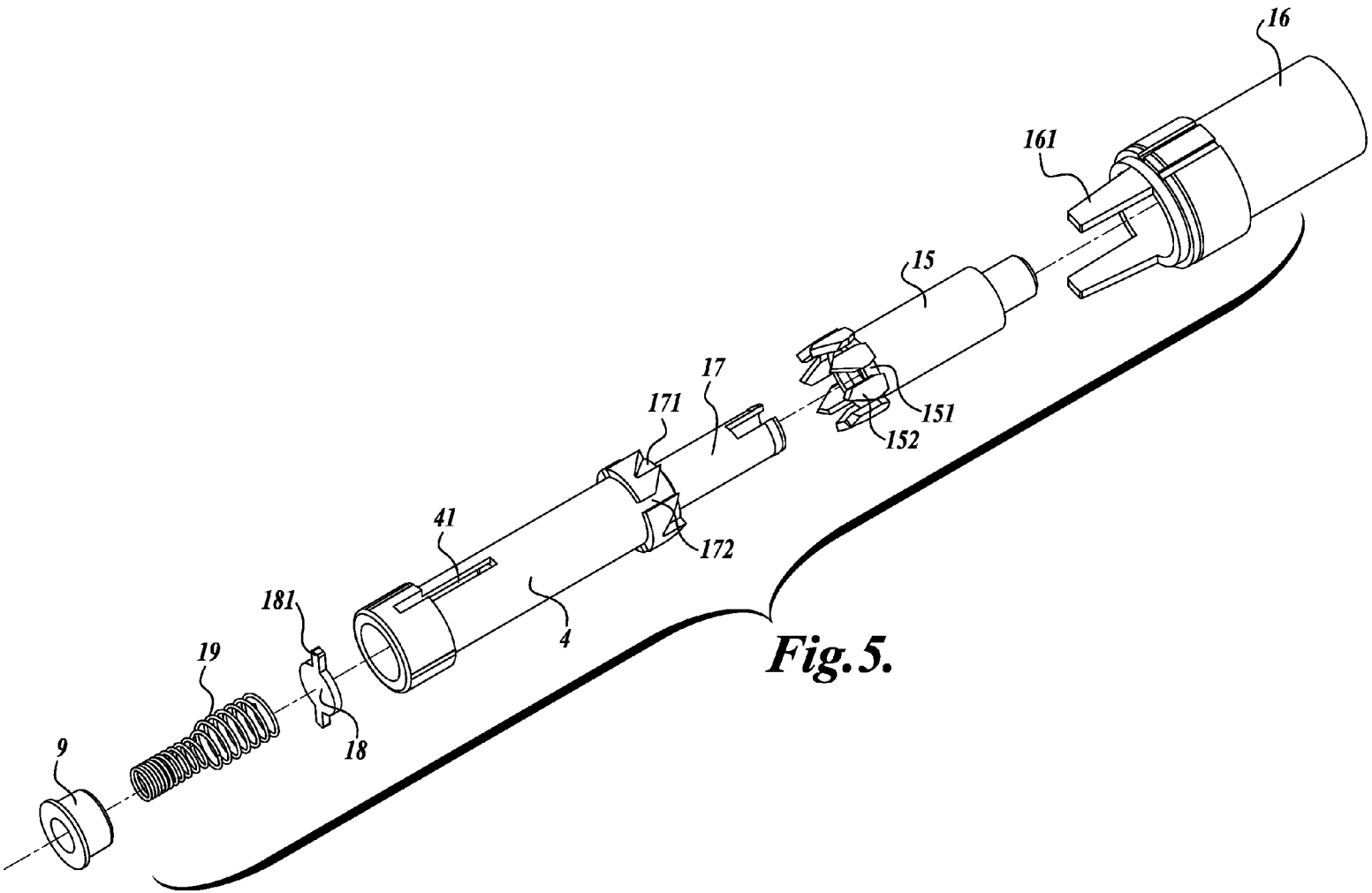
FIG. 5 is an exploded perspective view of the structure of the lamp pen shown in FIG. 4.

As illustrated in FIG. 5, a first guiding slot 151 adapted for slidably engaging with a guiding inner rib of the guiding sleeve 16 is disposed on the pressing wheel 15 so that the pressing wheel 15 cannot rotate and can only slide axially. In one embodiment, eight guiding slots 151 are disposed on the pressing wheel 15 and formed by guiding teeth 152. The push button 13, the spring 14, and the pressing wheel 15 form a push button assembly.

Pressing the push button 13 causes the pressing wheel 15 to engage the rotating wheel 17. The rotating wheel 17 includes four uniformly distributed chutes 171 and four uniformly distributed second guiding slots 172. The second guiding slots 172 and the chutes 171 are arranged alternately, so that when the rotating wheel 17 rotates, either the chute 171 receives one of the guiding longitudinal inner ribs disposed in the guiding sleeve 16 and the refill 23 extends out of the lower body 1, or a second guiding slot 172 slidably engages with one of the longitudinal inner ribs disposed in the guiding sleeve 16 and the refill 23 retracts inside the lower body 1. The pressing wheel 15 and the rotating wheel 17 are arranged such that the pressing wheel 15 rotates the rotating wheel 17 when the longitudinal inner rib of the guiding sleeve 16 no longer engages the second guiding slot 172 of the rotating wheel 17.

The front end of the rotating wheel 17 is integral with a spring housing 4. As illustrated in FIG. 5, two sliding slots 41 are disposed, in one embodiment, symmetrically, along a center line on the side wall of the spring housing 4. The two sliding slots 41 and two of the chutes 171 on the rotating wheel 17 are arranged in the same axial straight line.

A conductive plate 18 is disposed inside the spring housing 4. The conductive plate includes two conductive terminals 181 located, in one embodiment, on opposite sides of the plate 18. The terminals 181 protrude outwardly beyond an outer surface of the spring housing 4 through the sliding slots 41 and slidably engage the sliding slots 41.

Figure 4:
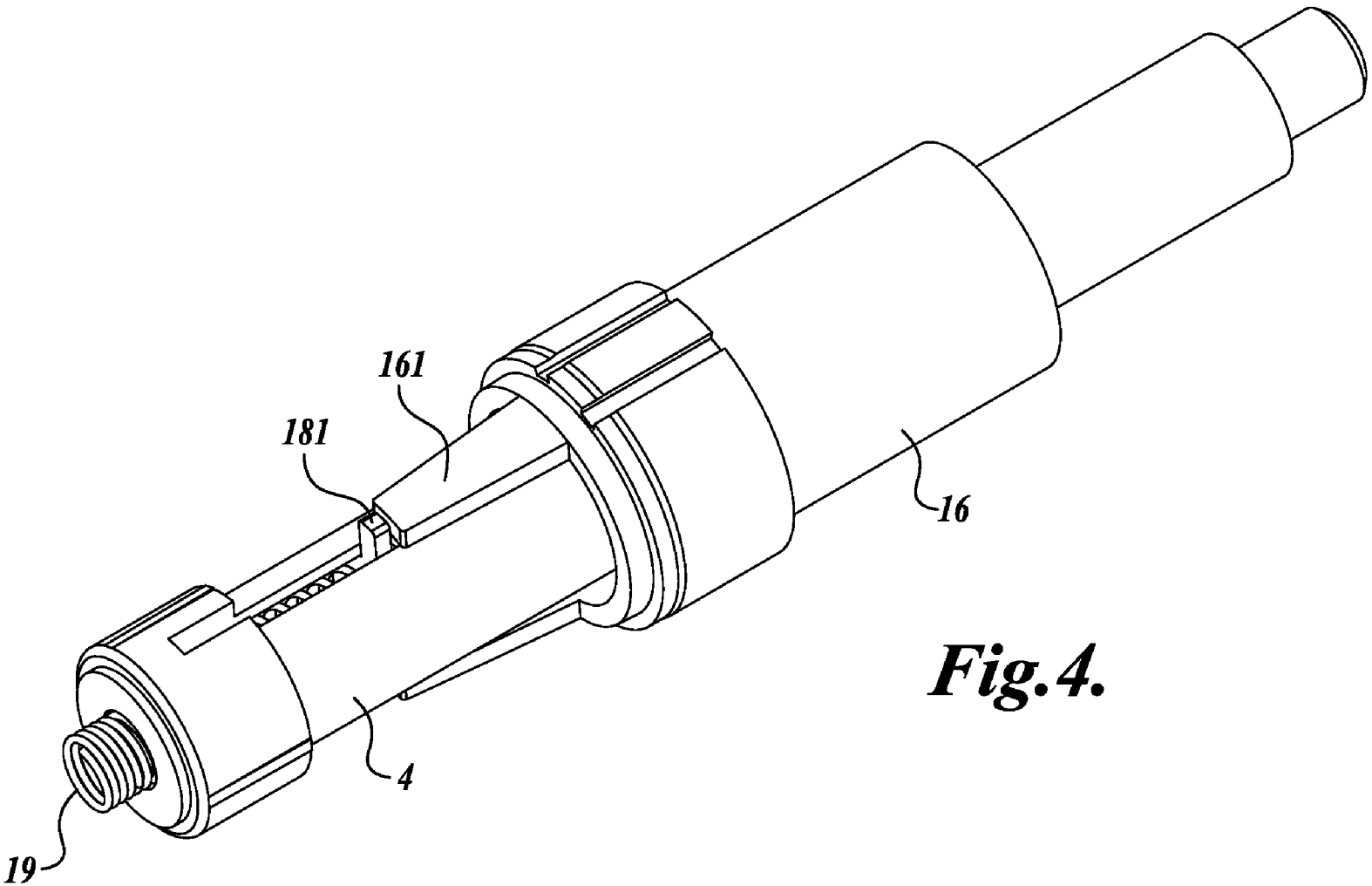
FIG. 4 is a perspective view of the structure of a contact portion between a guiding sleeve and a spring housing of the lamp pen shown in FIGS. 1-3.

As illustrated in FIGS. 4 and 5, at least one contact pin 161 adapted to contact the terminals 181 is integrally disposed on the guiding sleeve 16. In one embodiment, two contact pins 161 extend axially from opposite sides of the guiding sleeve 16 toward the lower body 1.

A third conductive spring 19 is disposed between the conductive plate 18 and the anode of the battery 21. In one embodiment, a diameter of an upper end of the third conductive spring 19 is greater than a diameter of a lower end thereof.

In one embodiment, the end of the spring housing 4 is capped with a fixing ring 9 such that the upper end of the third conductive spring 19 is pressed between the fixing ring 9 and the conductive plate 18, and the lower end of the third conductive spring 19 passes through the fixing ring 9 and contacts the anode of the battery 21.

In one embodiment, the central ring 5, the tail plug 6, and the guiding sleeve 16 are all made of plastics. The surfaces of the central ring 5, the tail plug 6, and the guiding sleeve 16 are all disposed with conductive layers to provide electric conduction.

Electrical current flows from one contact of the batteries 21 through the conductive spring 8, the tail plug 6, and the conductive spring 22 to the cathode of the lamp 24, and the anode of the lamp 24 contacts the central ring 5 and electrically connects to another contact of the batteries 21 through the conductive connector 10, the conductive spring 19 and the guiding sleeve 16 when the contact pin 161 of the guiding sleeve 16 engages the terminal 181 of the conductive plate 18, so that the lamp 24 illuminates.

When a downward coaxial force is repeatedly applied to the cap 13, the pressing wheel 15 engages the rotating wheel 17 of the rotating body assembly, causing the lamp pen to operate in four sequential positions as follows:

a first position wherein the first and second guiding slots 151 and 172 slidably engage the guiding longitudinal inner ribs inside the guiding sleeve 16 and the refill 23 is retracted into the lower body;

a second position wherein the chutes 171 receive the guiding longitudinal inner ribs of the guiding sleeve 16 and the writing end 30 of the refill 23 extends out of the lower body, and wherein the terminals 181 of the conductive plate 18 engage the contact pins 161 of the conductive sleeve 16 which completes an electrical circuit and causes the LED lamp to illuminate;

a third position wherein the refill 23 is again retracted as the first and second guiding slots 151 and 172 slidably engage the guiding longitudinal inner ribs of the guiding sleeve 16; and a fourth position wherein the refill 23 is again extended out of the lower body 1 but the LED lamp is not illuminated because the terminals 181 of the conductive plate 18 are not in contact with the contact pins 161 of the conductive sleeve 16. Further pressing of the cap 13 causes the lamp pen to return to the first position and start the sequence again.

While various illustrative embodiments have been illustrated and described, it will be appreciated that various changes can be made therein without departing from the spirit and scope of the invention.

The invention claimed is:

1. A lamp pen comprising:

a lower body;

an upper body attached to the lower body;

a refill disposed in at least the lower body;

a rotating body assembly that includes a housing having one or more slots defined therein, a conductive plate having one or more terminals that slidably engage the one or more slots, and a wheel having a plurality of chutes and longitudinal guiding slots defined between the chutes;

a guiding sleeve having one or more contact pins and one or more longitudinal inner ribs sized and oriented to slidably engage either the chutes or the longitudinal guiding slots of the wheel depending on the rotational position of the rotating body assembly; and a lamp having a first lead and a second lead, wherein the first lead is electrically coupled to the one or more contact pins of the guiding sleeve and the second lead is electrically coupled to a power source that is electrically coupled to the conductive plate, wherein the rotating body assembly is configured such that repeated application of a force on the rotating body assembly causes the rotating body assembly to rotate through a loop of positions in which the rotating body assembly moves sequentially from:

a first position in which the one or more longitudinal inner ribs of the guiding sleeve slidingly engage one or more of the longitudinal guiding slots of the wheel and the refill is retracted into the lower body;

to a second position in which the one or more longitudinal inner ribs of the guiding sleeve engage one or more of the chutes of the wheel causing at least a portion of the refill to extend out of the lower body, and in which at least one of the one or more terminals of the conductive plate contacts at least one of the one or more contact pins of the guiding sleeve causing the lamp to illuminate;

to a third position in which the one or more longitudinal inner ribs of the guiding sleeve slidingly engage one or more of the longitudinal guiding slots of the wheel and the refill is retracted into the lower body; and to a fourth position in which the one or more longitudinal inner ribs of the guiding sleeve engage one or more of the chutes of the wheel causing at least a portion of the refill to extend out of the lower body and the lamp is not illuminated.

2. The lamp pen of claim 1, wherein the lamp is a light emitting diode.

3. The lamp pen of claim 1, wherein the portion of the refill that extends out of the lower body has a writing end, and wherein the rotating body assembly is configured to engage a tail plug of the refill.

4. The lamp pen of claim 1, wherein two slots are defined in the housing of the rotating body assembly on opposing sides of the housing and the conductive plate has two opposing terminals that slidingly engage the two slots, and wherein the guiding sleeve has two contact pins on opposing sides of the guiding sleeve oriented to contact the two terminals of the conductive plate depending on the rotational position of the rotating body assembly.

5. The lamp pen of claim 1, further comprising a push button assembly that is slidably retained in the upper body and configured for repeated application of an axial force on the rotating body assembly.

6. The lamp pen of claim 1, further comprising a pressing wheel having a plurality of teeth configured to engage the chutes or the longitudinal guiding slots of the wheel when pressed and cause the rotating body assembly to rotate.

7. The lamp pen of claim 1, further comprising a conductive spring that, at least in part, electrically couples the first lead of the lamp to the one or more contact pins of the guiding sleeve or the second lead of the lamp to the power source.

8. The lamp pen of claim 1, wherein the wheel has four chutes and four longitudinal guiding slots defined alternately between the chutes.

9. A lamp pen comprising:

a body having a refill disposed therein;

a rotating body assembly having a conductive terminal and a wheel;

a guiding sleeve having one or more structures that alternately engage corresponding structures on the wheel depending on the rotational position of the rotating body assembly; and a lamp that is electrically coupled to a power source for illuminating the lamp when the conductive terminal of the rotating body assembly is electrically coupled to a conductive terminal on the guiding sleeve, wherein the rotating body assembly is configured to receive a repeated application of a force that causes the rotating body assembly to rotate through a loop of positions in which the rotating body assembly moves sequentially from:

a first position in which the refill is retracted into the body;

to a second position in which the one or more structures on the guiding sleeve engage the corresponding structures on the wheel causing at least a portion of the refill to extend out of the body;

to a third position in which the refill is retracted into the body; and to a fourth position in which the one or more structures on the guiding sleeve engage the corresponding structures on the wheel causing at least a portion of the refill to extend out of the body and the lamp is not illuminated; and wherein only when the rotating body assembly is in the second position is the conductive terminal of the rotating body assembly electrically coupled to the conductive terminal on the guiding sleeve causing the lamp to illuminate.

10. The lamp pen of claim 9, wherein the lamp is a light emitting diode.

11. The lamp pen of claim 9, wherein the rotating body assembly includes a housing with at least one slot defined therein that receives at least one protruding terminal of a conductive plate, and wherein the at least one protruding terminal of the conductive plate serves as the conductive terminal of the rotating body assembly.

12. The lamp pen of claim 11, wherein the guiding sleeve includes at least one contact pin oriented to contact the at least one protruding terminal of the conductive plate depending on the rotational position of the rotating body assembly, and wherein the at least one contact pin serves as the conductive terminal on the guiding sleeve.

13. The lamp pen of claim 9, further comprising a push button assembly configured to apply an axial force on the rotating body assembly when pushed.

14. The lamp pen of claim 9, further comprising a pressing wheel having a plurality of teeth configured to engage the wheel when pressed and cause the rotating body assembly to rotate.

15. The lamp pen of claim 9, further comprising a conductive spring that, at least in part, electrically couples the lamp to the conductive terminal on the guiding sleeve or to the conductive terminal of the rotating body assembly.

16. A lamp pen comprising:

a body having a refill disposed therein;

guiding means for facilitating extension and retraction of the refill with respect to the body;

rotating means for alternately engaging the guiding means and causing at least a portion of the refill to extend out of the body depending on the rotational position of the rotating means; and a lamp that is electrically coupled to a power source for illuminating the lamp when a conductive portion of the rotating means is electrically coupled to a conductive portion of the guiding means, wherein the rotating means are configured to rotate through a series of positions from a first position in which the refill is retracted in the body, to a second position in which the refill is extended and the rotating means are electrically coupled to the guiding means causing the lamp to illuminate, to a third position in which the refill is retracted, to a fourth position in which the refill is extended and the lamp is not illuminated, and to return to the first position when the rotating means further rotate.

17. The lamp pen of claim 16, wherein the lamp is a light emitting diode.

18. The lamp pen of claim 16, wherein the guiding means include at least one longitudinal inner rib that is sized and oriented to alternately engage a chute or a slot defined on the rotating means depending on the rotational position of the rotating means.

19. The lamp pen of claim 18, wherein the conductive portion of the rotating means includes a conductive plate with at least one terminal and the conductive portion of the guiding sleeve includes at least one contact pin configured to contact the at least one terminal of the conductive plate when the rotating means are in the second position.

20. The lamp pen of claim 16, further comprising a pressing wheel having a plurality of guiding teeth configured to engage the rotating means and cause the rotating means to rotate when the pressing wheel is pressed.

* * * * *